US005505564A

United States Patent [19]

Verstraeten

[11] Patent Number: 5,505,564

[45] Date of Patent: Apr. 9, 1996

[54] METHOD FOR PROVIDING A SHEET PILE WALL IN THE GROUND AND A PREFABRICATED WALL ELEMENT FOR CARRYING OUT SUCH METHOD

[75] Inventor: Alexander J. Verstraeten, Knokke-Heist, Belgium

[73] Assignee: Beheersmaatschappij Verstraeten B.V., Oostburg, Netherlands

[21] Appl. No.: 193,343

[22] Filed: Feb. 8, 1994

[30] Foreign Application Priority Data

Feb. 8, 1993 [NL] Netherlands ..... 9300245

[51] Int. Cl.[6] ..... E02D 5/20

[52] U.S. Cl. ..... 405/267; 37/347; 405/258; 405/284

[58] Field of Search ..... 405/258, 262, 405/267, 268, 274, 275, 276, 279, 284, 285, 286; 37/380, 347, 326, 329, 91, 94, 95, 97

[56] References Cited

U.S. PATENT DOCUMENTS

| | | | |
|---|---|---|---|
| 3,068,656 | 12/1962 | Booth et al. | 405/285 |
| 3,198,614 | 8/1965 | Powell | 405/285 |
| 3,412,562 | 11/1968 | Doughty . | |
| 4,407,612 | 10/1983 | van Weele | 405/285 |
| 4,679,965 | 7/1987 | Glaser et al. | 405/258 |
| 4,943,189 | 7/1990 | Verstraeten | 37/347 X |

FOREIGN PATENT DOCUMENTS

| | | |
|---|---|---|
| 2061979 | 6/1972 | Germany . |
| 247048 | 2/1964 | Netherlands . |
| 7900704 | 4/1980 | Netherlands . |
| 8502844 | 5/1987 | Netherlands . |
| 1719530 | 3/1992 | Russian Federation . |
| 8002168 | 10/1980 | WIPO . |

OTHER PUBLICATIONS

Netherlands Search Report 9300245.

*Primary Examiner*—Dennis L. Taylor
*Attorney, Agent, or Firm*—Kenyon & Kenyon

[57] ABSTRACT

A sheet pile wall is formed in the ground by excavating a first well and then excavating a second well spaced at a distance from the first well. The ground panel between the wells is then excavated to form a trench by using an excavating apparatus which is fitted with tubular guiding elements which are guided by the walls of the first and second wells. A prefabricated wall element having an arched center part is placed in the trench. The prefabricated wall element has edges which have meandering side faces. The edges of the wall element are brought into sealing contact with the walls of the trench, after which the first well is filled with concrete with the side face of the edge of the wall element serving as a shuttering to form a supporting nose engaging the side face.

6 Claims, 3 Drawing Sheets

METHOD FOR PROVIDING A SHEET PILE WALL IN THE GROUND AND A PREFABRICATED WALL ELEMENT FOR CARRYING OUT SUCH METHOD

This invention relates to a method for providing a sheet pile wall in the ground, which method comprises:

— excavating a first well by means of a drill head;

— subsequently excavating in a similar manner a second well, shifted relative to the first well over a distance;

— excavating the ground panel located between the first and the second well by means of an excavator which is fitted with tubular guiding elements, guided by the walls of the first and the second well during excavation; and — subsequently providing a pressure-resistant panel in the formed trench.

Such a method is described in non-prepublished Dutch patent application No. 92.01345. This known method is very suitable for providing deep partition walls in the ground, particularly because the excavating method ensures a proper connection of the ground panel to the wells located on either side thereof. The actual partition wall is formed by concrete poured into the previously excavated trench and filling both the trench and one of the adjacent wells simultaneously. While concrete is being poured, a support tube is present in the other well, which prevents this second well from being filled with concrete as well, since it must still be possible for this second well to function as a partition wall when the next ground panel is excavated.

FIG. 3 illustrates the excavating apparatus discussed in Dutch patent application No. 92.01345. The excavating apparatus 20 is fitted with tubular guiding elements 21, 22 which are guided by the walls of first well 31 and second well 32. The excavating apparatus excavates the ground panel 30 located between the first well 31 and the second well 32.

The object of the present invention is to improve this known method and in particular to render it suitable for providing sheet pile walls extending less deep into the ground, while a significant saving in material can be realized and the method can be further simplified by omitting a support tube, to be provided in every second well and subsequently removed again.

According to the invention, this object is realized by providing a method wherein a prefabricated wall element whose edges have a meandering side face is placed into the formed trench, the edges of the wall element are subsequently brought into sealing contact with the walls of the trench, after which the first well is filled with concrete, the side face of the edge of the wall element serving as shuttering to form a supporting nose engaging the side face.

The use of prefabricated wall elements has great practical advantages, because these wall elements can be given such a shape, for instance an arched shape, that it is no longer necessary to fill up the entire trench between two adjacent wells with a hardening mass. The wall thickness of the prefabricated wall element may be considerably less than the width of the trench, while the pressure resistance to the pressure exerted on the wall element by the surrounding ground is maintained. At the side of the wells the wall element can also be utilized as shuttering, so that the provision of a supporting tube in one of the adjacent wells can be omitted. Heretofore, the problem in using an arched wall element has been the transmission of forces occurring at the edges of the wall element to a supporting construction to be provided in the ground. By giving the side face of the wall element a meandering shape, a concrete pile having a supporting nose laterally engaging the wall element is formed when one of the wells is filled, ensuring a proper transmission of the forces applied to the wall element.

The present invention also relates to a prefabricated wall element for carrying out the method of the invention. This wall element comprises an arched center part and thickened edges with a meandering side face, which edges are provided with means for closing off the trench into which the wall element can be placed.

It is observed that Dutch patent application 79.00704 discloses a method for providing a sheet pile wall in the ground using arched wall elements. According to this method, sections, H-shaped in section, are driven into the ground, while an arched mold is placed between two successive sections, capable of finding support against the legs or the web of the sections mentioned. After the concrete poured into the mould has hardened, the mold parts are removed.

In this known method, it is difficult to drive successive sections into the ground at the right interspace and truly vertically, subsequently to provide an arched mould between these sections in the ground and withdraw it from the ground again afterwards with the concrete being poured simultaneously.

The method according to the invention and an embodiment of a prefabricated wall element for carrying out this method will be further explained hereinafter with reference to the accompanying drawing. The drawing schematically shows a portion of a sheet pile wall, comprising a prefabricated wall element and the concrete piles formed in the ground and connecting to both ends of the prefabricated wall element.

DETAILED DESCRIPTION

Figure 1:
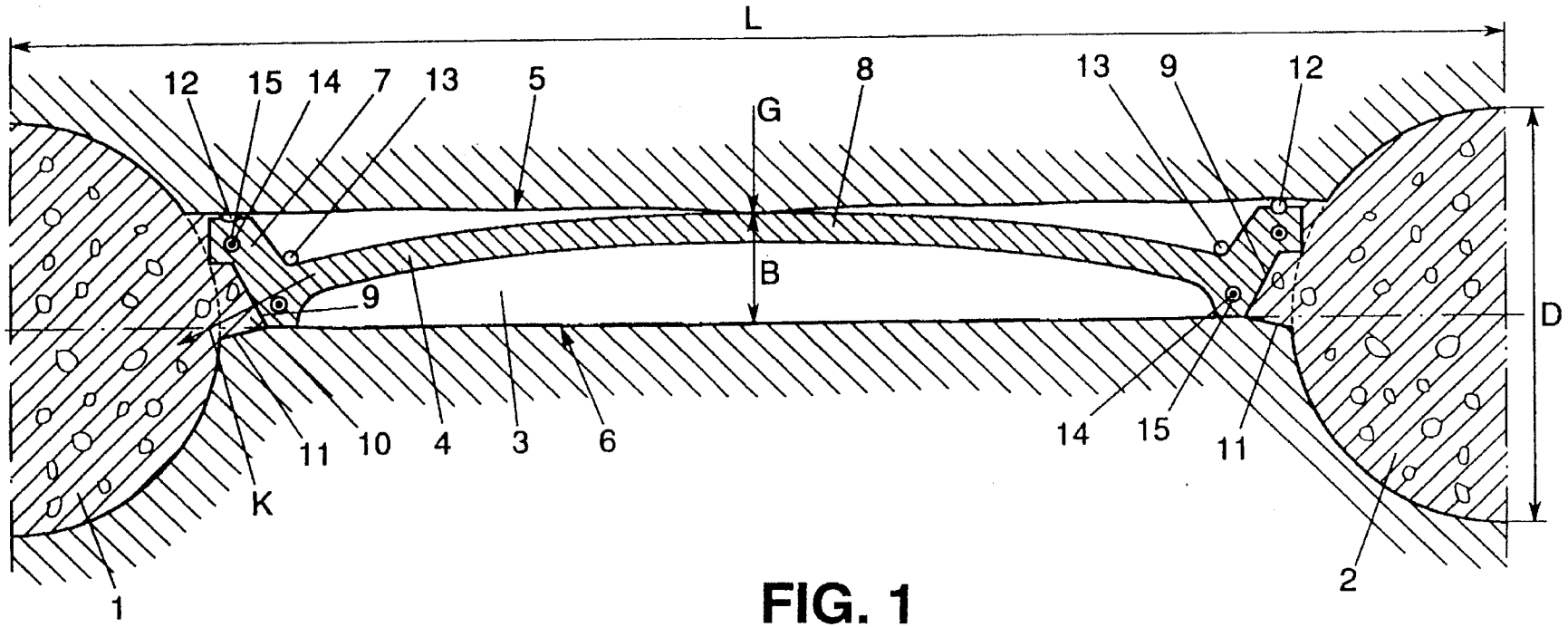
FIG. 1 is a schematic horizontal sectional view illustrating the prefabricated wall element of the present invention located in a trench.

In the method according to the invention, in a manner as described in non-prepublished Dutch patent application 92.01345, a first well 1 is excavated and subsequently a second well 2, spaced therefrom, after which the ground panel 3, located between the two wells 1, 2, is excavated by means of excavating equipment as described in the Dutch patent application mentioned. In this manner, the ground panel 3 can be excavated with great precision and it can be ensured that the side walls of the trench 3 connect to the wells 1, 2. The wells have a diameter D of, for instance, approximately 1,250 mm, while the distance L between the center lines of the wells 1, 2 is, for instance, approximately 3,750 mm. The equipment for excavating the ground panel 3 is of such design that the rear wall 6 of the trench to be excavated is within the plane of the center lines of the two wells 1, 2, while the width B of the trench 3 is approximately equal to the greatest thickness of the prefabricated wall element 4 to be placed into this trench 3, for instance approximately 400 mm. Of course, during excavation, a support liquid, such as for instance bentonire, is used so that the hole in the ground, consisting of the wells 1, 2 and the intermediate trench 3, is completely filled with support liquid.

Subsequently, the prefabricated wall element 4 is placed into the trench 3 so as to be truly vertical, optionally using suitable straightening means. The wall element 4 consists of an arched center part 8 and edges 7 connecting thereto, whose thickness approximately corresponds to the width B of the trench 3. In principle, the edges 7 of the wall element 4 will be some centimeters smaller than the width B. The side face 9 of the wall element 4, facing the well 1 or 2, is meander-shaped.

Because trench 3 into which the wall element 4 is placed should be sealed completely when concrete is poured into, for instance, the first well 1, to prevent concrete poured into the well 1 from finding its way into the trench 3, the wall element 4 should be in sealing abutment with both the front wall 5 and the rear wall 6 of the ground panel space. For this purpose, the wall element 4 is provided with suitable means which may consist of inflatable hoses 12, arranged in the faces of the edges 7 facing the front wall 5. In inflated condition, the hoses 12 project by some centimeters from the front face of the edge 7, sufficient to bridge the play between the trench width and the dimension of the wall panel 4 in the width direction of the trench, while the faces of the edges 7 facing the rear wall 6 of the trench 3 are pressed against the rear wall 6 and the front faces of the edges 7 will sealingly abut against the front wall 5 of the trench 3 by means of the pressurized hoses 12. In this manner, the portion of the trench 3 located between the edges 7 of the wall element 4 is sealed from the wells 1, 2. The faces of the edges 7 of the wall element 4 facing the rear wall 6 of the trench 3 are each provided with metal or synthetic strips 11, laterally projecting towards the wells 1, 2. Together with the meandering side faces 9 of the wall element 4, these strips 11 form a recess bounded on three sides. If concrete is subsequently poured into the first well 1 and the bentonite present therein is pumped off simultaneously, a concrete pile is formed in the first well 1, comprising a supporting nose 10 formed in the space bounded by the meandering side face 9 and the projecting part of the strip 11. After the concrete poured into the first well has hardened, a concrete pile having a laterally projecting supporting nose 10 is obtained, the side face 9 of the wall element being in precise abutment therewith, so that the forces exerted on the wall element 4 by the earth pressure G are transmitted in the direction K to the concrete pile 1.

It will be understood that the well 2 is not filled with concrete until the trench 3, located at the right-hand side thereof, has been excavated and a wall element 4 has been placed therein. In the above-described manner, the concrete pile 2 is provided with two supporting noses 10, facing leftward and rightward respectively, for taking up the forces exerted thereon by the left-hand and right-hand wall elements 4.

Instead of the metal or synthetic strips 11, inflatable hoses 12 may be arranged at the rear side of the wall element 4 as well for effecting a sealing abutment of the wall element 4 against the rear wall 6 of the trench 3.

The wall element 4 may comprise two tubes 13, located in the more or less angular space between the arched center part 8 and the edge 7 pointing toward the front wall 5 of the trench 3. In these tubes, straightening means (not shown) can be provided for positioning the wall element 4 truly vertically. After the wall element 4 has been enclosed between two adjacent concrete piles 1, 2, the straightening means can be removed from the tubes 13, whereafter, via these tubes, a hardening mixture can be pumped to the bottom of the trench 3 while the bentonite present in the trench 3 is removed simultaneously.

Figure 2:
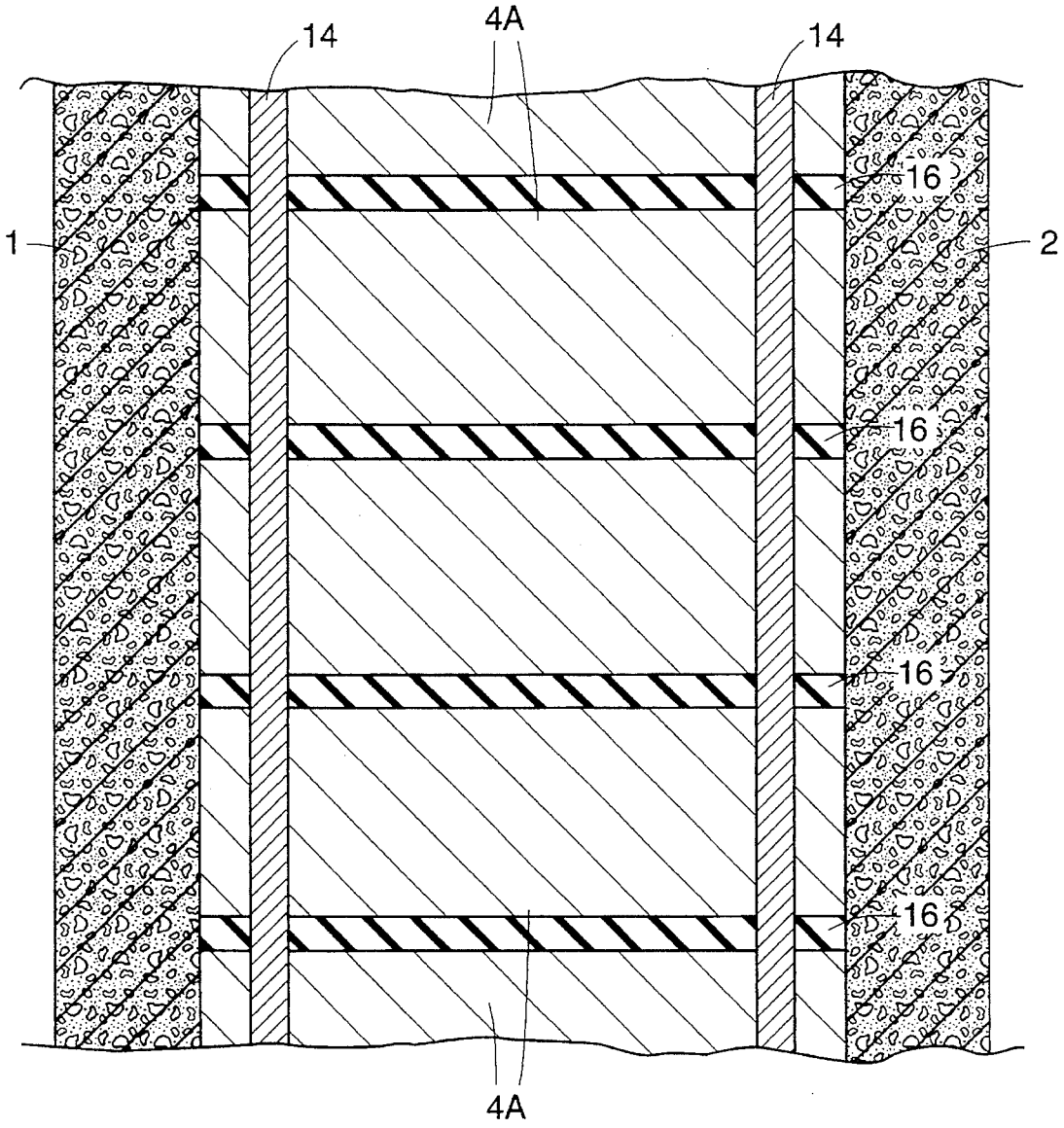
FIG. 2 is a schematic vertical sectional view illustrating a sealing strip located between separate segments of the prefabricated wall element of the present invention.
Figure 3:
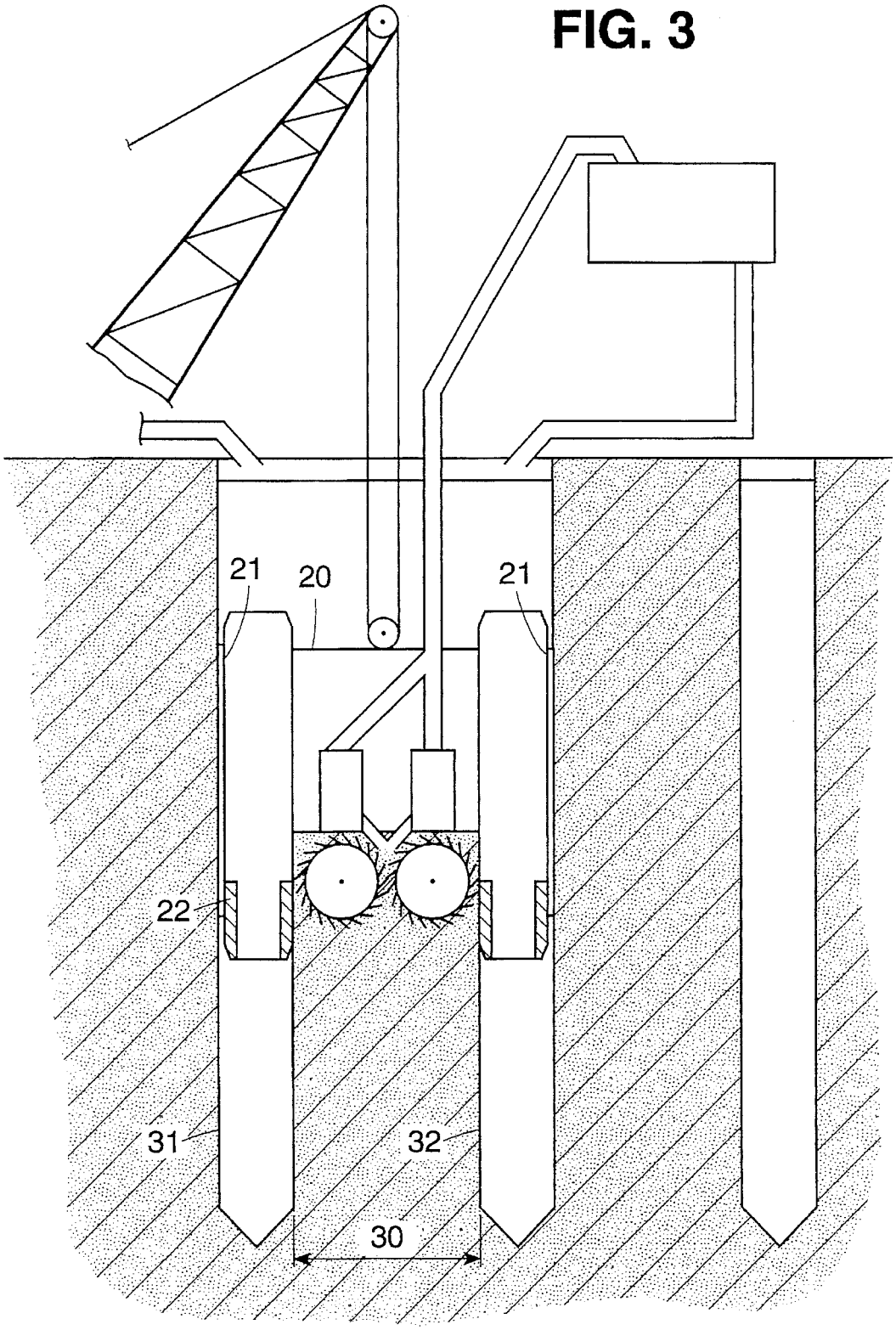
FIG. 3 is a schematic view of an example of an excavating apparatus which may be used in the practice of the method of the present invention.

If so desired, the space between the wall element 4 and the front wall 5 or the rear wall 6 of the trench 3 can be filled with, for instance, sand or gravel instead of a hardening mixture. The arched wall element 4 is eminently suitable for taking up the pressure force G exerted thereon by the surrounding ground, also in the case where the thickness of the wall element 4 is relatively slight. Preferably, the wall element is divided into segments 4A (FIG. 2) having a convenient height of, for instance, 1,500–2,500 mm. The segments are held together by pre-stress bars 14, extending into openings 15 provided in the thickened edges 7 of the wall segment. Thus, the wall element 4 built up from segments can readily be adapted to the desired height of the sheet pile wall to be provided. In the joints between successive segments 4A, sealing strips 16 are provided, for instance of rubber.

After hardening of the concrete poured into the wells 1, 2, the pre-stress bars 14 are removed from the wall element 4. They can subsequently be used in a new wall element 4, to be composed of segments. After the removal of the pre-stress bars 14, a certain degree of settlement can occur in the wall element 4 composed of segments, and this is desired.

I claim:

1. A method for providing a sheet pile wall in the ground, said method comprising:

excavating a first well by means of a drill head;

subsequently excavating in a similar manner a second well, shifted relative to the first well over a distance resulting in a ground panel between the first well and the second well;

excavating the ground panel located between the first well and the second well by means of an excavator which is fitted with tubular guiding elements, guided by the walls of the first well and the second well during excavation, thereby forming a trench;

subsequently placing a pressure resistant prefabricated wall element (4) whose edges (7) have a meandering side face (9) into the thus formed trench (3), the edges (7) of the wall element (4) are subsequently brought into sealing contact with the walls (5, 6) of the trench (3), after which the first well (1) is filled with concrete, the side face (9) of the edge (7) of the wall element (4) serving as shuttering to form a supporting nose (10) engaging the side face (9).

2. A prefabricated wall element (4) made of concrete for providing a sheet pile wall in the ground comprising an arched center part (8) and thickened edges (7) with a meandering side face (9), said edges (7) being provided with means for closing off a trench (3) into which the wall element (4) can be placed.

3. A wall element according to claim 2, characterized in that the means for closing off the trench (3) comprise inflatable hoses (12) arranged in the edges (7) of the wall element (4) and extending in the longitudinal direction of said edges.

4. A wall element according to claim 2, characterized in that the means for closing off the trench comprise a metal strip (11) provided on each edge (7) of the wall element (4), said strip (11) laterally projecting from the wall element (4) and forming, together with the meandering side face (9) of the wall element (4), a mold to form a supporting nose (10) on the concrete pile (1,2) to be poured.

5. A wall element according to claim 2, characterized in that the wall element (4) is built up from separate segments of limited height, a sealing strip being provided between adjacent segments, said segments being interconnectable by means of pre-stress bars (14) removably projecting into the openings (15) provided in the thickened edges (7) of each segment.

6. A method for providing a sheet pile wall in the ground according to claim 1, wherein said prefabricated wall element (4) has an arched center part (8) and thickened edges (7).

* * * * *